US009022299B2

(12) United States Patent
Jones

(10) Patent No.: US 9,022,299 B2
(45) Date of Patent: May 5, 2015

(54) RADIATORS

(75) Inventor: Gary Jones, Halifax (GB)

(73) Assignee: Basic Device Limited, Thurmaston (GB)

( * ) Notice: Subject to any disclaimer, the term of this patent is extended or adjusted under 35 U.S.C. 154(b) by 1219 days.

(21) Appl. No.: 12/595,790

(22) PCT Filed: Apr. 2, 2008

(86) PCT No.: PCT/GB2008/050237

§ 371 (c)(1),
(2), (4) Date: Feb. 11, 2010

(87) PCT Pub. No.: WO2008/125875

PCT Pub. Date: Oct. 23, 2008

(65) Prior Publication Data

US 2010/0133352 A1 Jun. 3, 2010

(30) Foreign Application Priority Data

Apr. 13, 2007 (GB) ..... 0707147.5

(51) Int. Cl.
*F24D 19/10* (2006.01)
*F24H 3/00* (2006.01)
*F24H 9/20* (2006.01)

(52) U.S. Cl.
CPC ..... *F24H 3/004* (2013.01); *F24D 19/1096* (2013.01); *F24H 9/2014* (2013.01)

(58) Field of Classification Search
CPC ..... F24H 3/004; F24D 19/1096
USPC .... 237/2 R, 2 A, 12, 70–71, 8 A, 8 R, 16, 81; 137/144
See application file for complete search history.

(56) References Cited

U.S. PATENT DOCUMENTS

| | | | | |
|---|---|---|---|---|
| 1,425,370 | A * | 8/1922 | Crosby | 137/176 |
| 4,319,601 | A * | 3/1982 | George | 137/124 |
| 4,818,845 | A * | 4/1989 | Koizumi et al. | 392/462 |
| 5,572,985 | A * | 11/1996 | Benham | 122/13.3 |
| 6,278,605 | B1 * | 8/2001 | Hill | 361/600 |
| 6,474,356 | B2 * | 11/2002 | Bouwkamp | 137/144 |
| 7,075,744 | B2 * | 7/2006 | Cumpson et al. | 360/73.03 |
| 7,606,639 | B2 * | 10/2009 | Miyaji | 700/296 |
| 2004/0262410 | A1 * | 12/2004 | Hull | 236/91 R |

(Continued)

FOREIGN PATENT DOCUMENTS

| | | |
|---|---|---|
| EP | 0209867 B | 1/1987 |
| EP | 0354631 B | 2/1990 |

(Continued)

*Primary Examiner* — Steven B McAllister
*Assistant Examiner* — Ko-Wei Lin
(74) *Attorney, Agent, or Firm* — Oliff PLC

(57) ABSTRACT

A radiator having a sealed flow path through which electrically heated fluid is arranged to pass. A control unit is provided in the radiator which is arranged to control operation of the radiator. The radiator also has a receiving unit arranged to receive at least one operation instruction from a remote control unit in use. The receiving unit is arranged to pass the at least one operation instruction to the control unit so that, in use, the radiator is controllable by the remote control unit. Also, an inlet pipe supplies water to a heater by a pump. The water then passes through a pipe comprising an inverted U-bend which controls air at the top of the bend. The radiator comprises a sealed system that plugs into the mains. Different radiators are able to communicate with each other.

15 Claims, 5 Drawing Sheets

(56) References Cited

U.S. PATENT DOCUMENTS

| | | | | |
|---|---|---|---|---|
| 2006/0027673 | A1* | 2/2006 | Fabrizio | 237/2 A |
| 2008/0083403 | A1* | 4/2008 | King et al. | 126/344 |
| 2009/0018705 | A1* | 1/2009 | Ouchi et al. | 700/291 |

FOREIGN PATENT DOCUMENTS

| | | | | | |
|---|---|---|---|---|---|
| EP | 0418179 | B | | 3/1991 | |
| EP | 0520827 | A | | 12/1992 | |
| EP | 0555534 | B | | 8/1993 | |
| EP | 0582795 | B | | 2/1994 | |
| EP | 0594885 | B | | 5/1994 | |
| EP | 0594886 | B | | 5/1994 | |
| EP | 0716273 | B | | 6/1996 | |
| EP | 0886813 | B | | 12/1998 | |
| EP | 1024330 | B | | 8/2000 | |
| EP | 1085288 | B | | 3/2001 | |
| EP | 1160640 | B | | 12/2001 | |
| EP | 1160752 | A | | 12/2001 | |
| EP | 1184768 | B | | 3/2002 | |
| EP | 1355212 | A | | 10/2003 | |
| EP | 1433993 | A | | 6/2004 | |
| EP | 1460347 | A | | 9/2004 | |
| EP | 1460507 | A | | 9/2004 | |
| EP | 1491980 | A | | 12/2004 | |
| EP | 1653165 | A | | 5/2006 | |
| GB | 2184867 | A | | 7/1987 | |
| GB | 2193306 | A | | 2/1988 | |
| GB | 2198264 | A | | 6/1988 | |
| GB | 2202619 | A | | 9/1988 | |
| GB | 2206685 | A | | 1/1989 | |
| GB | 2211593 | B | | 7/1989 | |
| GB | 2228069 | A | | 8/1990 | |
| GB | 2249615 | A | | 5/1992 | |
| GB | 2251063 | A | | 6/1992 | |
| GB | 2298265 | A | * | 8/1996 | F24H 3/00 |
| GB | 2305720 | A | | 4/1997 | |
| GB | 2387669 | B | | 10/2003 | |
| GB | 2393498 | A | | 3/2004 | |
| GB | 2411462 | A | | 8/2005 | |
| WO | 00/70271 | | | 11/2000 | |
| WO | 01/56332 | | | 8/2001 | |
| WO | 01/82018 | | | 11/2001 | |
| WO | 02/48615 | | | 6/2002 | |
| WO | 03/025469 | | | 5/2003 | |
| WO | 03/042607 | | | 5/2003 | |
| WO | 03/093916 | | | 11/2003 | |
| WO | 2004/102077 | | | 11/2004 | |
| WO | 2005/022953 | | | 3/2005 | |
| WO | 2005/045326 | | | 5/2005 | |
| WO | 2005/067619 | | | 7/2005 | |
| WO | 2005/069820 | | | 8/2005 | |
| WO | 2005/071510 | | | 8/2005 | |

* cited by examiner

RADIATORS

CROSS-REFERENCE TO RELATED APPLICATIONS

This application claims priority to International Application No. PCT/GB2008/050237 filed Apr. 2, 2008, and Great Britain Application No. 0707147.5 filed Apr. 13, 2007, the contents of which are incorporated by reference herein.

TECHNICAL FIELD AND BACKGROUND OF THE INVENTION

The present invention relates to radiators, methods of operating radiators, a radiator system and a method of operating a radiator system, methods of controlling the electricity consumed in a unit including at least one radiator and radiator electricity consumption systems.

Various prior patents have gone before relating to heating systems but very few that relate to self-contained radiators where there is a sealed flow path in the radiator. Patents that relate to general heating systems are GB 2206685, GB 2411462, GB 2305720, GB 2251063, GB 2298265, GB 2211593, WO 2005/045326, WO 2004/102077, WO 03/042607, WO 2005/022953, EP 1653165 and EP 088681. The applicant is also aware of remote control in other patent publications which are not particularly relevant to the present invention including EP 1160640, EP 1460347, EP 1355212, EP 1184768, EP 1085288, EP 0716273, EP 1491980, EP 0594886, WO 2005/069820, WO 03/093916 and GB 2 198 264.

SUMMARY OF THE INVENTION

According to the present invention there is provided an apparatus and method as set forth in the appended claims. Other features of the invention will be apparent from the dependent claims, and the description which follows.

According to one aspect of the invention there is provided a radiator comprising a sealed flow path through which electrically heated fluid is arranged to pass, a control unit arranged to control operation of the radiator and a receiving unit arranged to receive at least one operation instruction from a remote control unit in use, and which is arranged to pass the at least one operation instruction to the control unit so that, in use, the radiator is controllable by the remote control unit.

Preferably, the at least one operation instruction comprises a temperature setting.

Preferably, the at least one operation instruction comprises operation start and stop times for the radiator.

The present invention also includes a method of operating a radiator when the radiator is as herein referred to and vice versa.

Further features of the invention are defined in the claims and elsewhere in the specification and any of the features may be combined with any aspect of the present invention.

According to another aspect of the present invention there is provided a radiator comprising a sealed flow path through which electrically heated fluid is arranged to pass, including monitoring means arranged, in use, to monitor the rate of electricity consumption of the radiator and to control the flow of electricity to the radiator in dependence upon the monitored consumption.

According to another aspect of the present invention, a method of controlling the electricity consumed in a unit including at least one radiator comprising a sealed flow path through which electrically heated fluid is arranged to pass comprises monitoring the electricity being consumed by the or each radiator in the unit and controlling the rate of consumption of electricity by the or each radiator in dependence upon the monitored consumption.

The radiator may be arranged, in use, to control the amount of electricity that the or each radiator is able to consume over a period of time.

Preferably, monitoring takes place on a ring main. Preferably, the or each radiator in the unit or a control for the or each radiator includes a control that restricts the overall electricity consumed by the or each radiator to a predetermined level over a predetermined period of time. Preferably, at least a minimum amount of electricity is available in a predetermined period of time. Preferably, at least one radiator in the unit can override the control that restricts the overall electricity consumed.

The radiator may include means for communicating with another radiator or a central control so that, in use, the other radiator or central control can determine that the radiator is unavailable.

The radiator may include a flow path including a gas controller comprising up and downstream parts of the path and an intermediate portion between these up and downstream parts, the intermediate portion being at a greater elevation than the up and downstream parts.

The radiator may include first communication means arranged to co-operate with second communication means.

The radiator may include monitoring means arranged, in use, to monitor the rate of electricity consumption of the radiator and to control the flow of electricity to the radiator in dependence upon the monitored consumption.

The radiator may include restriction means arranged, in use, to restrict the amount of electricity that the or each radiator is able to consume over a period of time.

The radiator may be located in a zone and may include means for monitoring the entry of a person into the zone and means to cause heat to be added to the zone, if required, after the entry of a person into the zone has been monitored.

According to another aspect of the invention a radiator comprises a heater and a sealed flow path through which, in use, heated fluid is arranged to pass, the flow path including a gas controller comprising up and downstream parts with the path and an intermediate portion between these up and downstream parts, the intermediate portion being at a greater elevation and the up and downstream parts.

According to a further aspect of the present invention, a method of operating a radiator including a sealed flow path comprising heating fluid and causing the heated fluid to pass through a gas controller by flow first through an upstream part, then through a intermediate portion and then through a downstream part with the intermediate portion being at a greater elevation than the up and downstream parts with gas being controlled in the intermediate portion and with fluid passing through the intermediate portion.

According to another aspect of the invention, a radiator system includes at least one radiator comprising a sealed flow path through which, in use, heated fluid is arranged to pass, the radiator including first communication means, the system further including separate second communication means arrange to co-operate with the first communication means.

According to another aspect of the present invention a method of using a radiator system including at least one radiator comprising a sealed flow path through which, in use, heated fluid is arranged to pass comprises first communication means on the radiator communicating with second communication means separate from the radiator.

The present invention also includes a method of operating a radiator system when the radiator is as herein referred to.

The radiator may include a gas controller comprising up and downstream parts and an intermediate portion being at a greater elevation than the up and downstream parts.

The radiator may include monitoring means arranged, in use, to monitor the rate of electricity consumption of the radiator and to control the flow of electricity to the radiator in dependence upon the monitored consumption.

The radiator may include restriction means arranged, in use, to restrict the amount of electricity that the or each radiator is able to consume over a period of time.

The radiator may be located in a zone and may include means for monitoring the entry of a person into the zone and means to cause heat to be added to the zone, if required, after the entry of a person into the zone has been monitored.

The following features of the invention may be combined with any aspect of the invention as herein referred to.

The second communication means may be provided by a second radiator spaced from the first radiator, the second radiator also including a sealed flow path through which, in use, heated fluid is arranged to pass. There may be three or more such radiators each including communication means. At least one radiator may be able to communicate with another radiator. Each radiator may be arranged, in use, to communicate with all of the other radiators. Alternatively only some of the radiators may be able to communicate with all of the other radiators. Alternatively none of the radiators may be able to communicate with all of the other radiators. Alternatively each radiator may be able to communicate with some but not all radiators. Alternatively each radiator may be able to communicate with only one other radiator with no radiator being unable to communicate with another. Radiators may be able to communicate in series with each other. Radiators may be able to control the amount of electricity consumed by at least one other radiator.

Alternatively at least one or all radiators may be able to communicate with second communication means that are not on a radiator.

When a communication between two communication means is unable to be made an alarm may be given. The alarm may be remote from the radiators and, alternatively or additionally, remote from all of the communicate means.

At least one radiator may include authorisation means which authorise the radiator to be able to operate when the communication means cooperate with another. When a communication between two communication means is unable to be made, at least one radiator may be prevented from operating.

According to a further aspect of the present invention a method of controlling the electricity consumed in a unit including at least one radiator comprising a sealed flow path through which electrically heated fluid passes, comprising controlling the amount of electricity that at least one radiator is able to consume over a period of time.

According to another aspect of the present invention a radiator electricity consumption system in a unit including at least one radiator comprising a sealed flow path through which, in use, electrically heated fluid is arranged to pass and restriction means arranged, in use, to restrict the amount of electricity that the or each radiator is able to consume over a period of time.

The present invention also includes a radiator electricity consumption system when used in a method of controlling the electricity consumed in a unit and vice versa.

The radiator may include a gas controller comprising up and downstream parts and an intermediate portion being at a great elevation than the up and downstream parts.

Preferably, the gas controller has a cross-sectional area of more than 5 mm2. Preferably, the gas controller has a cross-sectional area of less than 70 mm2. Preferably, the lowermost portion of the intermediate part is at a greater elevation than the up and down stream parts. Preferably, the gas controller comprises an inverted U. Preferably, the up stream or down stream portions or both include a vertically extending channel along at least part of their extent. Preferably, the radiator includes at least one radiating portion with the gas controller being located adjacent to that radiating portion. Preferably, the gas controller is to one side of the radiating portion. Preferably, including two radiating portions with the gas controller being located between those two radiating portions. Preferably, the sealed flow path includes fluid flowing in at least one radiating portion. Preferably, fluid leaving the downstream part is supplied to at least one radiating portion. Preferably, the gas controller is at a lower elevation than the uppermost extent of the flow path in at least one radiating portion. Preferably, the gas controller is downstream of the fluid driving means. Preferably, the gas controller is downstream from the heater. Preferably, the fluid driving means is downstream from the heater.

The radiator may include first communication means arranged to co-operate with separate second communication means.

The radiator may include monitoring means arranged, in use, to monitor the rate of electricity consumption of the radiator and to control the flow of electricity to the radiator in dependence upon the monitored consumption.

The radiator may be located in a zone and may include means for monitoring the entry of a person into the zone and means to cause heat to be added to the zone, if required, after the entry of a person into the zone has been monitored.

The following features of the present invention may be used with any aspect of the present invention as herein referred to.

The method may comprise varying the amount of electricity that is able to be consumed over a specific period for instance by a person paying more or less for the electricity over a period.

The method may comprise permitting at least one radiator to always be able to consume electricity for at least part or parts of the period.

The method may comprise restricting the amount of electricity that is able to be consumed by a plurality of radiators and prioritising the consumption of at least one radiator over another.

The method may comprise effecting the restriction to limit the rate of consumption of at least one radiator either for part of parts of the time in any one period or for all of that period. The method may comprise preventing at least one radiator from consuming power for at least part of the period.

The restriction may be effected by an authorised person. The restriction may be effected by control means which may affect the restriction based on an amount paid.

According to a further aspect of the present invention an electricity consumption system is arranged, in use, to control the electricity consumed in a unit that includes at least one radiator comprising a sealed flow path through which, in use, electrically heated fluid is arranged to pass, the system including monitoring means arranged, in use, to monitor the electricity consumption of the or each radiator in a unit and control means arranged, in use, to control the flow of electricity to the or each radiator in dependence upon the consumption monitored by the monitoring means.

The present invention also includes a method of controlling the electricity consumption in a unit with an electricity consumption system as herein referred to and vice versa.

The radiator may include a gas controller comprising up and downstream parts and an intermediate portion being at a greater elevation than the up and downstream parts.

The radiator may include first communication means arranged to co-operate with separate second communication means.

The radiator may include restriction means arranged, in use, to restrict the amount of electricity that a radiator is able to consume over a period of time.

The radiator may be located in a zone and may include means for monitoring the entry of a person into the zone and means to cause heat to be added to the zone, if required, after the entry of a person into the zone has been monitored.

The method may comprise controlling the rate of consumption such that the rate of consumption by two or more radiators is always less than the maximum rate that could be consumed by all radiators if each were operating at their maximum rate.

The method may comprise controlling the rate of consumption of two or more radiators by allowing at least one radiator to consume more than at least one other radiator. The method may comprise the control first allowing a first radiator to be able to consume electricity at a greater rate than a second radiator and then allowing the second radiator to be able to consume at a greater rate than the first.

The method may comprise monitoring the rate of electrical consumption by the or each radiator and also the rate of consumption of at least one other item in the unit and controlling the rate of consumption of the radiator in dependence upon that monitoring. The method may comprise monitoring the rate of electrical consumption of the complete unit.

The unit may comprise a house.

According to another aspect of the present invention a method of operating a radiator in a zone comprises monitoring the entry of a person into a zone causing a radiator to add heat to the zone, if required, after the initial monitoring of the entry.

The method may comprise adding heat after a predetermined period of time has passed since the person entered the room provided the person is still monitored as being in the room.

The method may comprise adding heat if the activity of the person falls below a certain rate after they have been monitored as having entered the room.

The addition of heat may enable the radiator to supply heat if the temperature in the room is below a predetermined temperature.

The radiator may include first communication means arranged to co-operate with second communication means.

The radiator may include monitoring means arranged, in use, to monitor the rate of electricity consumption of the radiator and to control the flow of electricity to the radiator in dependence upon the monitored consumption.

The radiator may include a gas controller comprising up and downstream parts and an intermediate portion being at a greater elevation than the up and downstream parts.

The radiator may include restriction means arranged, in use, to restrict the amount of electricity that the or each radiator is able to consume over a period of time.

According to a further aspect of the present invention a zone heating system includes a radiator and a monitor arranged to monitor the entry of a person into the room and control means arranged to turn the radiator on after the entry of the person into the zone has been monitored.

According to another aspect of the invention, there is provided a radiator comprising a sealed flow path through which electronically heated fluid is arranged to pass, wherein a triac is in thermal communication with a heater used to electrically heat the fluid, so that the triac is cooled by the heater.

The present invention also includes a zone heating system when operated by a method as herein referred to and vice versa.

Preferably, the fluid driving means comprises a pump and the controller is arranged to intermittently start the pump when operation of the radiator is initiated. Preferably, the controller is arranged to send a pulsed start signal to the pump. Preferably, a duty cycle of the pulsed start signal is gradually increased.

Preferably, the radiator comprises a separable cover arranged to surround the radiator when mounted on a wall.

BRIEF DESCRIPTION OF THE DRAWINGS

The present invention may be carried into practice in various ways but one embodiment will now be described by way of example and with reference to the accompanying figures, in which:—

DETAILED DESCRIPTION OF THE INVENTION

Figure 1:
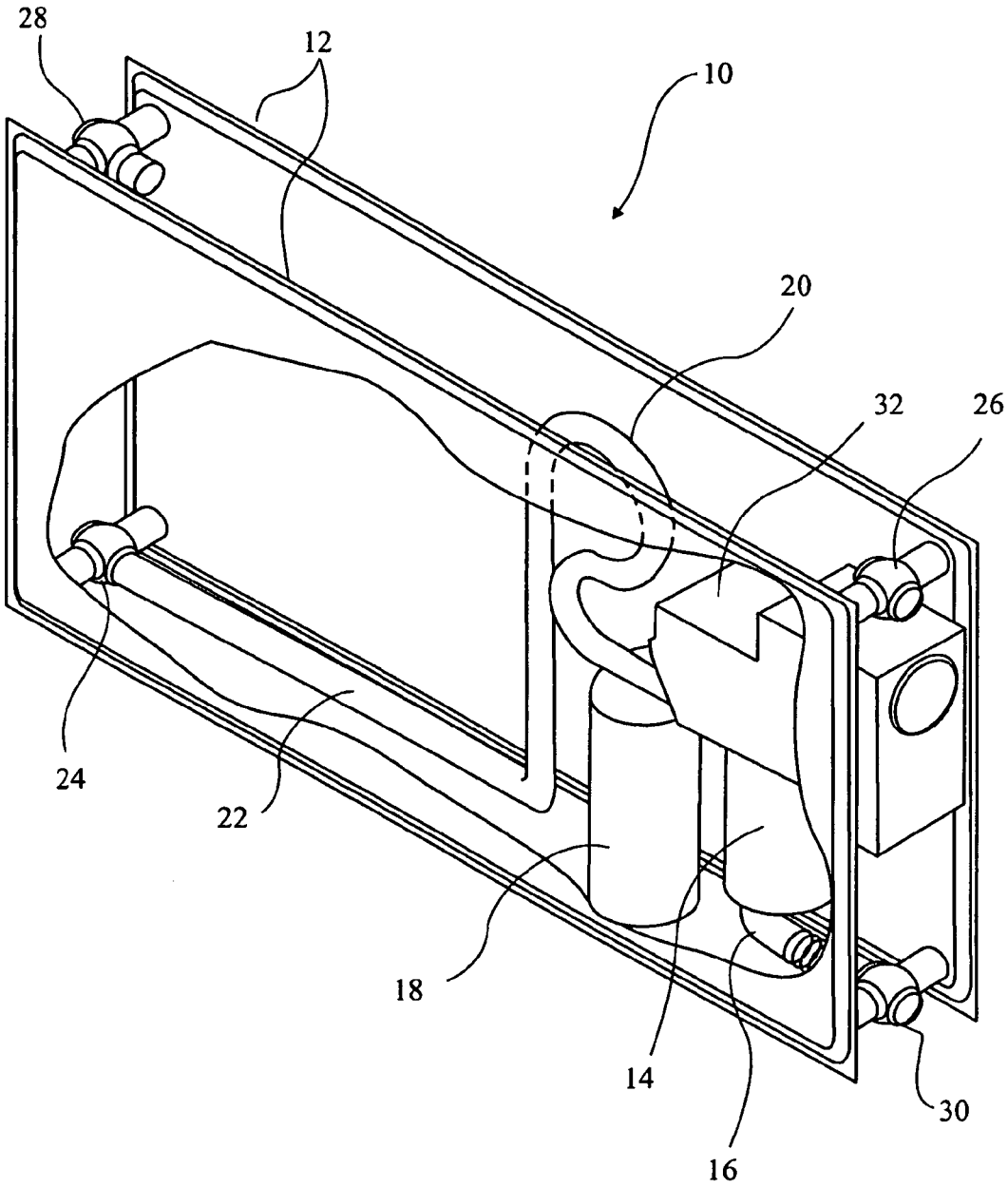
FIG. 1 is a perspective view of a radiator 10.
Figure 2:
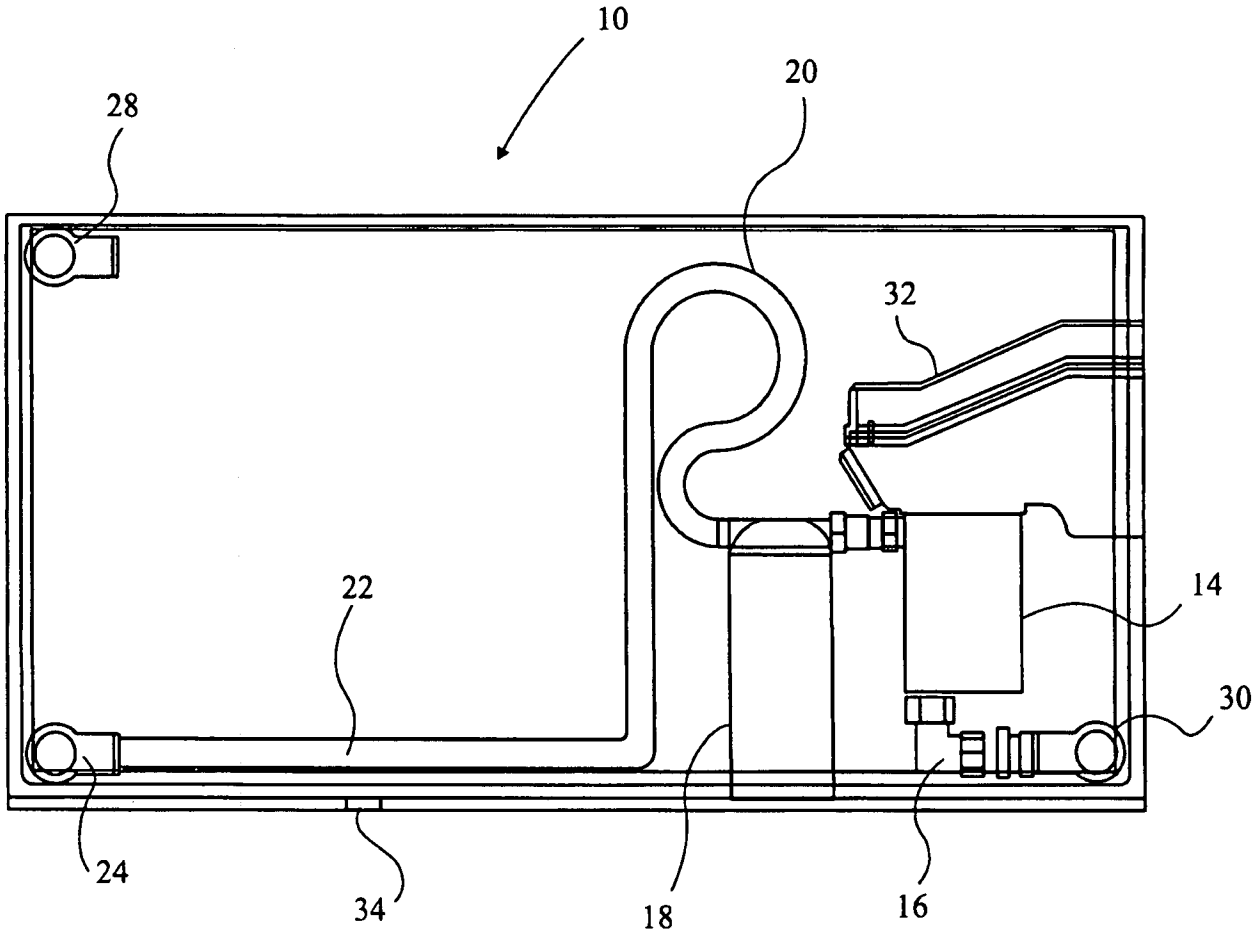
FIG. 2 is a side view of the radiator 10 with one radiator panel 12 removed.
Figure 3:
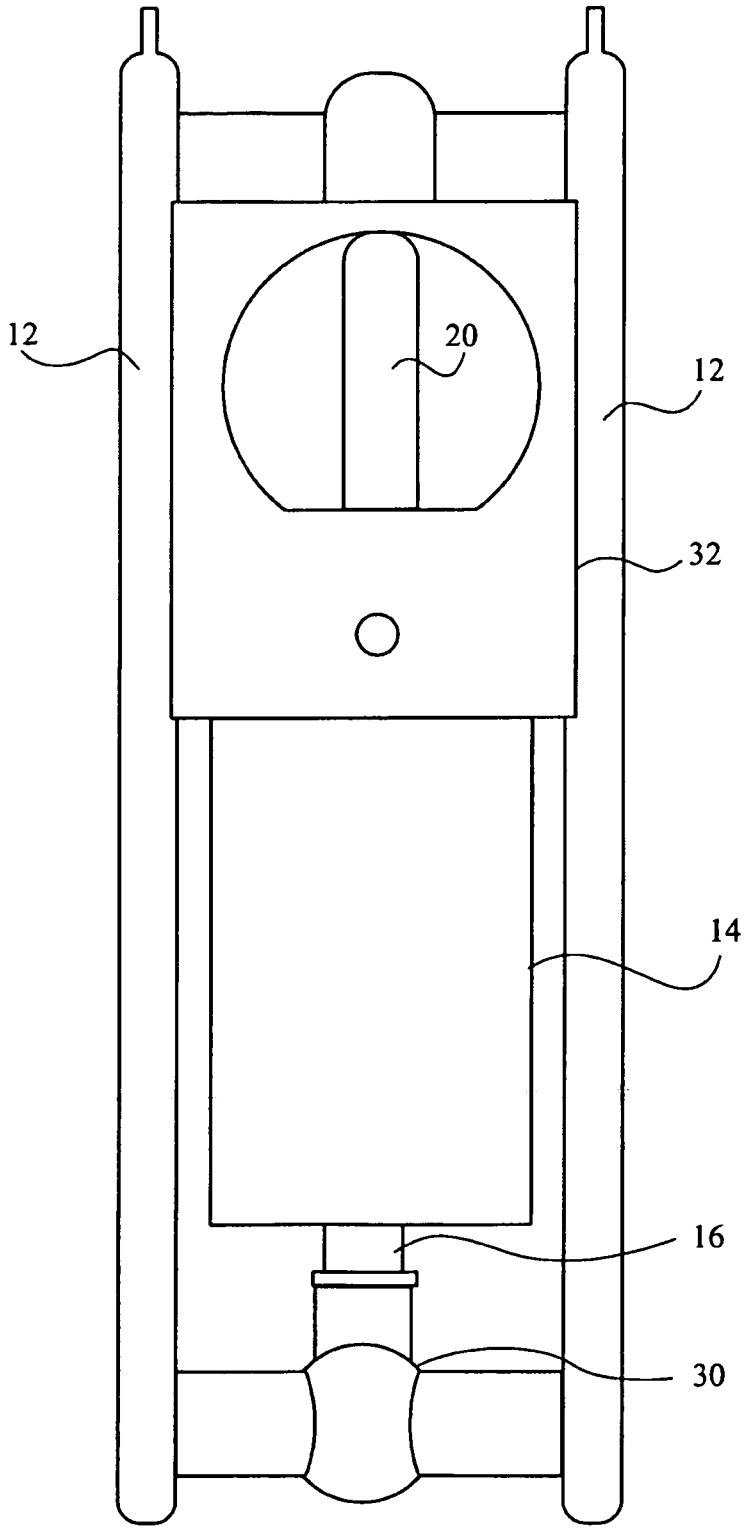
FIG. 3 is an end view of FIG. 2.
Figure 4:
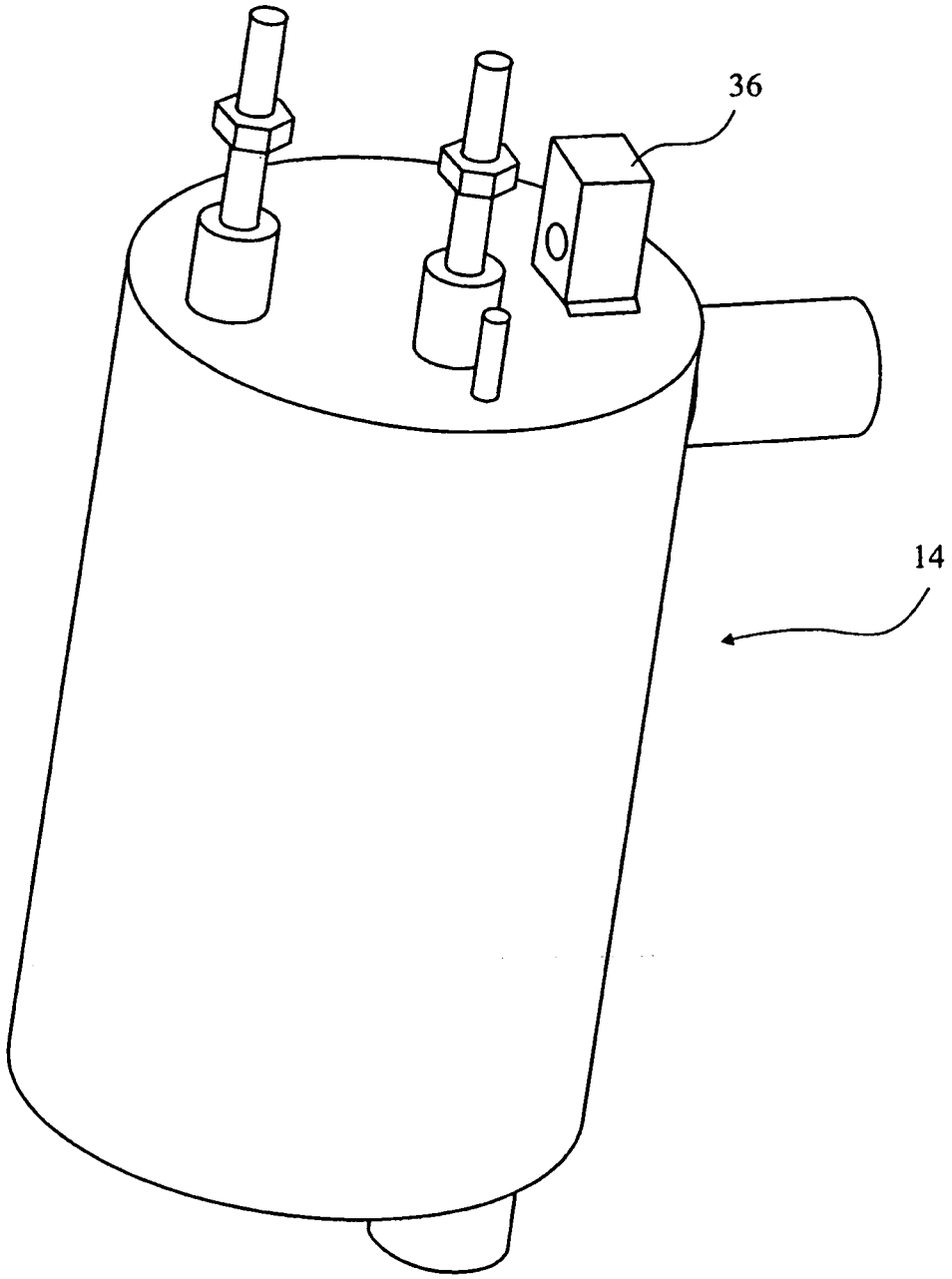
FIG. 4 is a perspective view of a boiler or heater 14 of the radiator.
Figure 5:
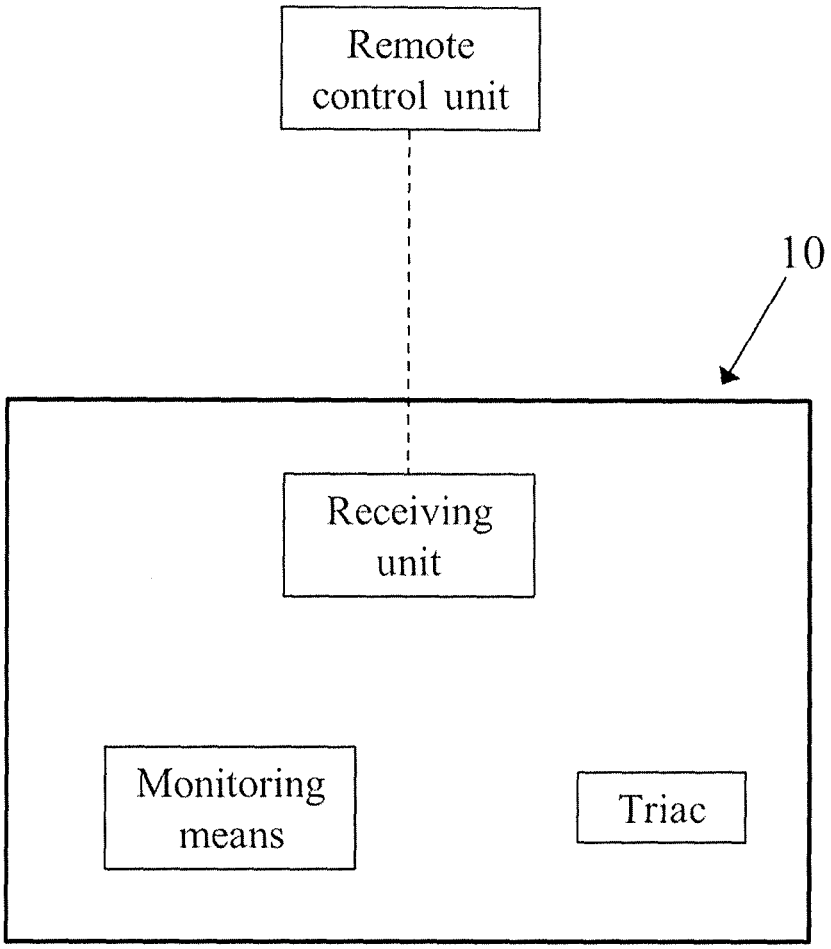
FIG. 5 is a block diagram of the radiator 10.

As seen in FIGS. 1 and 2, water enters the boiler in an inlet pipe 16 and is drawn through the heater 14 by a pump 18. The water then passes through a pipe that extends first upwardly then downwardly to form a loop or inverted U-bend 20. The pipe may have a cross-sectional area of more than 5 mm2 or 7 mm2 or 9 mm2 or 12 mm2. The cross section may be less than 70 or 50 or 30 mm2 and is preferably in the region of 20 mm2. The pipe may have a circular cross-section. The water then flows along a horizontal pipe 22 before passing into a knuckle joint 24. From the knuckle joint 24 the water then flows through the heater panels 12 at each side and upwardly through those panels to knuckle joints 26 and 28 at the top region of the radiator before exiting the radiator panels 12 through a lower knuckle joint 30 that feeds the inlet pipe 16 for the heater.

The radiator is set up in factory conditions. Water with antifreeze content and rust inhibitor is added through an inlet valve (not shown) in one of the knuckle joints with the air leaving through an outlet valve (not shown) in another such joint. The water flows through the complete radiator system to remove substantially all of the air in the system. The water is also heated and the internal pressure is set at 0 or 4 bar for instance or at any desired pressure. The pressure may vary during use. Then the inlet and outlet valves are closed and the system is transported to the area where it is to be used.

In use the radiator is plugged into the electric mains to provide the power for the radiator and for a control unit 32 that is mounted on and sealed to the top of the heater 14. As the control unit is sealed on top of the boiler, and as there are no switches or other contacts that are exposed to the atmosphere, the radiator is able to be used in a bathroom.

Whilst most of the air is removed from the system it remains slightly aerated. The air gathers at the top region of the U-bend 20. Water flowing through the system thus contains no air and, when the water reaches the U-bend 20 the water is simply able to flow around the loop. As the air does not move from the region of the bend, or because the U-bend 20 creates a restriction to flow, the radiator is silent in its mode of operation and there is no 'gurgling' that is associated with conventional radiators In use a number of radiators (for instance, from 1, to a plurality of radiators to, for instance, 7) are distributed around a house with perhaps two radiators being in one room and a single radiator being in another room. The radiators are not connected together and each has its own pump, boiler and internal water circulation. Each radiator is plugged into the same electric mains system.

The radiators that are sold each include the same control unit even though all of the controls that will be described later in a unit may not necessarily be utilised for any particular radiator. The radiators can be sold with all items being of the same size but with, for instance, the heater having a one or two or three KW coiled heating element. Various modes of operation will now be described. The modes are not mutually exclusive and could be used together, at the same time, where feasible, or at different times.

1. The electrical supply to the or each radiator is switched on. The radiator senses the lowest temperature in the room with a sensor 34 on this radiator being connected to the control unit 32. It will be appreciated that the lowest temperature under normal conditions is at the floor level and the sensor is located adjacent to the floor on the inlet to the radiator. The radiator then heats up the room. When the room reaches the selected temperature as picked up by the sensor 34, the heater is switched off either for a predetermined period of time or until the sensed temperature drops below a predetermined level. When those events occur the heater is switched on again to resume the heating of the room. The pre-selected temperature can be set for a particular radiator in the home or factory. Alternatively, a manual dial can be set to increase or decrease the selected temperature. The boiler includes a cut out to prevent the water in the system exceeding 100° C. The adjustment, the sensor 34 and the cut out may be present in each of the embodiments.

2. This is similar to mode one. The difference is that the control unit includes a timer that can be set manually or by remote operation such that the power for the boiler is switched on or off at selected times. When the power is switched on it operates in accordance with Mode One referred to above.

3. The user is provided with a radio controlled transmitter. This is able to communicate remotely with the control unit. The user can request that the or each radiator comes on or off at the same predetermined time or at separate times that may be predetermined. Alternatively or additionally, the user can determine that the or each radiator is set at the same temperature value or at separate temperatures. The user is able to manually adjust the actual temperature that a room being heated by the radiator is desired to reach in accordance with Mode One referred to above.

4. It will be appreciated that the user may arrive home from work and want four radiators to switch on, prior to their return, in the downstairs rooms such that the bottom of the house is warm on arrival. The user may not retire to the bedroom until later on at night. Consequently, in a conventional central heating system, the bedrooms are heated, unnecessarily, for a significant period of time in the evenings. Mode Four attempts to alleviate this problem. Using the controls described above or below the hall and kitchen radiators may come on first, before the occupant returns home. Then the dining room radiator may come on half an hour after followed by the sitting room. Finally, one hour before the occupant retires, the bathroom and the bedroom radiators are turned on. The radiators in the rooms that are to be vacated may be turned off, or set to maintain a lower temperature before the occupant leaves that room.

The user may be provided with a radio transmitter. The user can request individual radiators that include radio receivers or groups of such radiators, to come on at different times and to have different temperature values. Each radiator has a thermostat which can be set remotely and which can be used to control the temperature of that radiator.

5. The radio transmitter may not be able to contact all of the radiators in the house because of the distance between the radio receivers in the different radiators from the transmitter or because of the obstruction of dividing walls. Consequently, each control unit is provided with not only the receiver previously referred to but also with a transmitter. In this way, radiator one that is able to receive a signal from the users' radio transmitter is able to contact radiator two that is not in contact with the radio transmitter directly by radiator one transmitting a signal determined by the users' transmitter that is received by radiator two such that radiator two can know its desired timing of operation and its desired temperature setting when on. Similarly, radiator two may be able to talk to radiator three in the same manner or radiator one can contact a plurality of radiators two and, alternatively or additionally a plurality of radiators two may be able to contact a plurality of radiators three. Each of the radiators may refer back to a previous radiator to inform that radiator that it has received the signal and will operate as requested. The radio transmitter may be that contained in one or more radiators rather than, or in addition to a radio transmitter separate from a radiator.

6. In this embodiment radiators may only be able to come on when they receive a signal from another radiator or from a central control. Each signal may be coded. In this way theft of a radiator is useless as the radiator is unable to function without receiving the signal.

7. Alternatively or additionally each radiator may communicate with another radiator or a central control either to state that the radiator is turned on or to state that the radiator is unavailable, even if required, to be turned on. When each radiator can communicate with another radiator any combination of communications is possible such as one communicating with any or all or the communication being in a series between the radiators such that, for instance, if a radiator is missing from the series the missing radiator (and possibly the remaining radiators) is unable to operate. In this way it is possible to readily determine when a radiator is present or when a radiator is absent or malfunctioning. A signal may be sent from a radiator or each radiator or a central control to state that communication is lacking. Thus a faulty radiator can be repaired or the fact that theft of a radiator has occurred can be quickly picked up to enable quick repair or prevent further theft or to apprehend the thieves should they return for another radiator.

8. It will be appreciated that some rooms may be desired to be heated to a higher level or heated more rapidly than other rooms. Alternatively or additionally, some rooms may start off at a colder temperature than other rooms. The radio transmitters and receivers on each radiator communicate with each other such that any desired sequence or method of heating can be achieved. For instance, in order to avoid a rapid power drain on the mains of the house with, for instance, seven radiators all being on at 3KW, radiator one may switch on first to achieve a certain, less than maximum, desired level of heating in that room, then radiator two may be switched on and then turned off without the maximum temperature being reached and then radiator three being switched on without the predetermined temperature being reached. Then radiator three may be turned off with radiator one then coming on and off and then radiator two coming on and off and then radiator three coming on and off with that sequence being repeated until the desired temperatures have been reached. When the desired temperatures have been reached the radiator that first senses that it should come on again may do so and whilst the heater of that radiator is operating the heater from another radiator which wants to come on because the temperature in its room has dropped may be prevented from doing so until the heater from the aforementioned radiator switches off. Alternatively the radiators may come on sequentially with each radiator reaching its desired temperature before switching off and the next radiator switching on. The radiator or radiators that are first to switch on may be controlled to be the one or ones that are furthest from their predetermined temperature setting for that room.

9. The radiators are provided with a triac that is connected to the bracket 36 that is welded or brazed to the top of the heater 14. The body of the heater 14 will, typically, reach a temperature of 85° C. It is the triac that determines whether the heater 14 is switched on or off upon the signal that the triac receives from the temperature sensor 34 (providing that any of the controls referred to indicate that operation is alright). The triac operates at a significant temperature of, for instance, 130° C. It is necessary to cool the triac and as the triac is in intimate contact with the bracket 36 that is at 85° C., the triac is cooled by the lower temperature of the boiler. Any of the controls referred to herein may also be connected on the boiler.

10. Often radiators will heat a room when no-one is present, for instance, because of unforeseen circumstances. Accordingly the room may include a control, either on a radiator in that room or a sensor remote from the radiator, that can initiate operation of the radiator when a person is present. When a person is present the radiator turns on or may go from trying to maintain a lower temperature to trying to maintain a higher temperature. If the radiator is in a group of radiators as referred to the radiator may go from a low priority to a high priority.

The control though may only turn on or alter the operating conditions of a radiator to prevent a person entering the room only briefly activating the radiator. That control may comprise motion being detected for a predetermined minimum period of time or alternatively or additionally motion being detected and with a level of activity of that person decreasing, possibly for a predetermined period of time. Thus the radiator need not come on if a person is cleaning the room and is therefore maintaining their warmth through physical exertion. The radiator will come on though if a person sits down. There may be a time delay after a person leaves the room before the radiator switches off, or decreases the temperature in a room or switches to low priority in a system.

11. Reference has been made to controlling the operation of the radiators to restrict the power being consumed at any one time. The power may be monitored to maintain the power consumed by all of the radiators at or below a predetermined level such as below 50 amps. That should leave enough power for other devices such as kettles or irons. Alternatively the monitoring may include all of the power being consumed being monitored to maintain the power below a predetermined level such as 60 amps. Thus if the radiators are on they can consume up to 60 amps. However, if the iron and kettle are both turned on one or more of the radiators could draw less power or be turned off. When radiator power is to be decreased, the reduction may be in accordance with the priority of each radiator in a group of radiators as referred to herein. The monitoring may take place on a business or domestic ring main. In the preferred embodiment, control is achieved by switching on/off selected radiators as required.

12. The radiators or a control for the radiators may include a control that restricts the overall power consumed by the radiators to a certain level over a predetermined period. The radiators may still operate as referred to anyway herein. However, they will not exceed a predetermined consumption level over a predetermined period. Thus a person will not spend more on heating than a predetermined amount which amount may be determined by a particular spend per week. Alternatively or additionally the power consumed by the or each radiator could be determined by a first control that a user cannot override such that at least some heat can be available each day even through a user may want more heat. Alternatively or additionally power may be available for all or part or parts of a period such as power to a bedroom with such power being outside of an amount of electricity that has been paid for or with the spend for the power for that radiator being taken of the payment before the power or spend for the other radiators is used. At least one radiator may be controlled such that the rate of consumption cannot be exceeded at least one time during the period and preferably for all of that period.

With such a system, whilst this user may want the radiators on all of the time they may be turned off, for instance, after midnight for 6 hours, or alternatively or additionally turned down for periods or restricted in their consumption at any one time thereby ensuring that the person will always have some heat. The user may pay money into an account or a meter and may vary the amount paid. The control referred to herein will then be effected and the amount of heating available will then be able to be increased if more money is paid. In this way heat is available each day and a user is not left without any heat at the end of a week.

13. Whilst wireless communication has been referred to the radiators may also communicate with each other or with a control of a user through a signal in the electric mains. Alternatively or additionally the communication and settings may be effected wirelessly based on the ZigBee™ low-power short-distance wireless standard developed by the ZigBee™ Alliance (see www.zigbee.org).

14. In one embodiment, each radiator is arranged to communicate with a remote control unit. The remote control unit is arranged to send at least one operation instruction to a receiving unit on the radiator. The receiving unit is arranged to pass the at least one operation instruction to a control unit within the radiator so that the radiator is controlled based on the at least one operation instruction. In practice, the at least one operation instruction is a room temperature setting which the radiator is set to achieve. Also, the at least one operation instruction includes on and off times for the radiator.

More than one radiator is operable from a single remote control unit. Additionally or alternatively, several radiators can be arranged into zones, each zone having a dedicated remote control unit.

15. Each pump 18 in each radiator is configured to have a soft start. In other words, each pump receives a pulsed start signal which causes the pump to begin pumping the sealed fluid relatively gently such as intermittently. In particular, the pulsed signal has a duty cycle which is arranged to be increased during a predetermined start phase of the pump. In this way, the inertia of the sealed fluid can be gradually overcome, thereby reducing start-up noise.

16. In addition, a cover is provided for low surface temperature applications. This is particularly useful in hospitals, care homes and nurseries. Indeed, the low surface temperature option is useful where there are vulnerable people at risk of being burned by contact with the radiator. The low surface temperature option comprises a cover which is arranged to surround the radiator when mounted on a wall. The cover is box-like having an open side which is arranged to abut against the wall, leaving the remaining five sides to surround the radiator.

17. It will be appreciated that each embodiment can have water in the radiator. The term "substantially water" includes water having other agents therein such as antifreeze and rust inhibitor.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A radiator comprising:

an electric heater;

a sealed flow path through which, in use, electrically heated fluid is arranged to be driven by a fluid driving unit, wherein the sealed flow path comprises an inverted U-bend comprising a continuously curving top region that restricts air flow through the sealed flow path by gathering air at the continuously curving top region;

a control unit arranged to control operation of the radiator; and a receiving unit arranged to receive at least one operation instruction from a remote control unit in use, and which is arranged to pass the at least one operation instruction to the control unit so that, in use, the radiator is controllable by the remote control unit.

2. The radiator as claimed in claim 1, wherein the at least one operation instruction comprises a temperature setting.

3. The radiator as claimed in claim 1, wherein the at least one operation instruction comprises operation start and stop times for the radiator.

4. The radiator as claimed in claim 1, including a monitoring unit configured to monitor the rate of electricity consumption of the radiator and to control the flow of electricity to the radiator in dependence upon the monitored consumption.

5. The radiator as claimed in claim 4, wherein the monitoring unit is configured to control the amount of electricity that the radiator is able to consume over a period of time.

6. The radiator as claimed in claim 4, wherein the radiator includes a communication unit configured to communicate with a second radiator or with the remote control unit so that, in use, the second radiator or the remote control unit can determine that the radiator is unavailable.

7. The radiator as claimed in claim 1, wherein the flow path includes a gas controller comprising up and down stream parts of the path and an intermediate portion between those up and down stream parts, the intermediate portion being at a greater elevation than the up and down stream parts.

8. The radiator as claimed in claim 7, including a first fluid communication unit arranged to co-operate with a second fluid communication unit.

9. The radiator as claimed in claim 1, comprising a triac in thermal communication with the heater used to electrically heat the fluid, so that the triac is cooled by the heater.

10. The radiator as claimed in claim 1, wherein the fluid driving unit comprises a pump and the control unit is arranged to intermittently start the pump when operation of the radiator is initiated.

11. The radiator as claimed in claim 1, comprising a separable cover arranged to surround the radiator when mounted on a wall.

12. The radiator as claimed in claim 1, wherein the sealed flow path has a fixed volume.

13. A radiator comprising:

an electric heater;

a sealed flow path through which, in use, electrically heated fluid is arranged to be driven by a fluid driving unit, wherein the sealed flow path comprises an inverted U-bend restricting air flow through the sealed flow path by gathering air at a top region of the inverted U-bend;

a control unit arranged to control operation of the radiator;

a receiving unit arranged to receive at least one operation instruction from a remote control unit in use, and which is arranged to pass the at least one operation instruction to the control unit so that, in use, the radiator is controllable by the remote control unit; and a monitoring unit configured to monitor the rate of electricity consumption of the radiator and to control the flow of electricity to the radiator in dependence upon the monitored consumption, wherein the monitoring unit is configured to control the amount of electricity that the radiator is able to consume over a period of time.

14. A radiator comprising:

an electric heater;

a sealed flow path through which, in use, electrically heated fluid is arranged to be driven by a fluid driving unit, wherein the sealed flow path comprises an inverted U-bend restricting air flow through the sealed flow path by gathering air at a top region of the inverted U-bend;

a control unit arranged to control operation of the radiator;

a receiving unit arranged to receive at least one operation instruction from a remote control unit in use, and which is arranged to pass the at least one operation instruction to the control unit so that, in use, the radiator is controllable by the remote control unit, wherein the at least one operation instruction comprises operation start and stop times for the radiator; and a monitoring unit configured to monitor the rate of electricity consumption of the radiator and to control the flow of electricity to the radiator in dependence upon the monitored consumption.

15. A radiator comprising:

an electric heater;

a sealed flow path through which, in use, electrically heated fluid is arranged to be driven by a fluid driving unit, wherein the sealed flow path comprises an inverted U-bend restricting air flow through the sealed flow path by gathering air at a top region of the inverted U-bend;

a control unit arranged to control operation of the radiator;

a receiving unit arranged to receive at least one operation instruction from a remote control unit in use, and which is arranged to pass the at least one operation instruction to the control unit so that, in use, the radiator is controllable by the remote control unit; and a monitoring unit configured to monitor the rate of electricity consumption of the radiator and to control the flow of electricity to the radiator in dependence upon the monitored consumption, wherein the radiator includes a communication unit configured to communicate with a second radiator or with the remote control unit so that, in use, the second radiator or the remote control unit can determine that the radiator is unavailable.

* * * * *